US007111811B2

(12) United States Patent
Weldy

(10) Patent No.: US 7,111,811 B2
(45) Date of Patent: Sep. 26, 2006

(54) HOPPER STAND

(75) Inventor: Derrell J. Weldy, Campo, CA (US)

(73) Assignee: Pla-Cor Incorporated, Santee, CA (US)

( * ) Notice: Subject to any disclaimer, the term of this patent is extended or adjusted under 35 U.S.C. 154(b) by 49 days.

(21) Appl. No.: 10/837,297

(22) Filed: Apr. 30, 2004

(65) Prior Publication Data

US 2005/0242249 A1 Nov. 3, 2005

(51) Int. Cl.
*A47G 23/02* (2006.01)

(52) U.S. Cl. ..... 248/150; 222/185.1; 248/163.2; 248/164.2; 248/176.1

(58) Field of Classification Search ..... 248/150, 248/151, 158, 163.1, 164, 431, 166, 176.1; 156/578; 118/43, 413, 415, 419, 429; 52/194, 52/197; 222/185.1
See application file for complete search history.

(56) References Cited

U.S. PATENT DOCUMENTS

| | | | | | |
|---|---|---|---|---|---|
| 922,909 | A | | 5/1909 | Jensen | |
| 1,731,139 | A | | 10/1929 | Kift | |
| 2,713,609 | A | * | 7/1955 | Niklason | 348/373 |
| 2,743,893 | A | | 5/1956 | Johnston, Jr. | |
| 2,746,703 | A | * | 5/1956 | Emery | 248/150 |
| 2,794,496 | A | * | 6/1957 | Strand, Jr. | 248/165 |
| 2,925,979 | A | | 2/1960 | Walker | |
| 3,148,924 | A | * | 9/1964 | Habler | 248/128 |
| 4,064,993 | A | | 12/1977 | Getner | |
| 4,223,859 | A | | 9/1980 | Erickson | |
| 4,398,690 | A | | 8/1983 | Rutledge | |
| 5,169,449 | A | | 12/1992 | Raught | |
| 5,676,793 | A | | 10/1997 | Martin | |
| 5,996,947 | A | | 12/1999 | Palmieri, III | |
| 6,578,802 | B1 | | 6/2003 | Thier | |
| 6,595,475 | B1 | * | 7/2003 | Svabek et al. | 248/150 |
| 6,722,618 | B1 | * | 4/2004 | Wu | 248/166 |
| 6,814,333 | B1 | * | 11/2004 | Freiburger | 248/150 |
| 2004/0187435 | A1 | * | 9/2004 | Smythe | 52/749.1 |

* cited by examiner

*Primary Examiner*—Ramon O Ramirez
(74) *Attorney, Agent, or Firm*—Gordon & Rees LLP

(57) ABSTRACT

A stand for supporting a hopper for applying joint compound to a drywall corner bead has first and second pairs of legs which cross over and are pivoted together at their crossover point in a scissors-like manner. Each pair of legs has a cross bar extending between its upper ends, and spaced connecting straps extend transversely between the cross bars in the deployed position of the stand, the connecting straps being of predetermined length to control the maximum spacing between the cross bars. Each connecting strap is slidably engaged with the respective cross bars for movement along the cross bars. A hopper is seated on top of the cross bars with a reduced length lower portion of the base extending downwardly between the cross bars. The two connecting straps are moved into engagement with opposite sides of the hopper base in order to support the hopper.

9 Claims, 4 Drawing Sheets

HOPPER STAND

BACKGROUND OF THE INVENTION

The present invention relates generally to stands of the type for supporting objects at a raised level, and is particularly concerned with a hopper stand for supporting a hopper of the type used to coat drywall corner bead with drywall mud or joint compound, as well as a combined hopper and stand assembly.

It is known to use a hopper filled with joint compound having a feeder in its base to apply joint compound to corner bead. Typically, the hopper is placed directly on top of a bucket standing on the ground, so that excess drywall mud will drip from the feeder into the bucket as the corner bead is pulled out of the feeder. This arrangement has some disadvantages. Firstly, the hopper will not be very stable and will tend to wobble as the corner bead or drywall tape is pulled through the feeder. Secondly, the operator must bend or crouch down in order to feed the tape into one end of the feeder and pull it out at the other end, which is awkward and uncomfortable.

A stand has been used in the past to support the hopper at a raised height such that the operator does not have to bend over in order to coat the corner bead. The prior stand has two pairs of crossed legs which are pivoted together and each joined by a cross bar at their upper ends, and the hopper is simply placed freely on top of the cross bars. Chains are used to secure the legs together below the pivot in order to lock the legs in an open or deployed position of the stand. This arrangement places the hopper at a more convenient height for use, but does not solve the problem of instability or wobbling of the hopper.

SUMMARY OF THE INVENTION

It is an object of the present invention to provide a new and improved stand for a hopper used in applying drywall mud to corner beads. It is an additional object of the invention to provide a new and improved hopper and stand assembly.

According to one aspect of the present invention, a hopper stand is provided, which comprises a first pair of spaced, parallel legs each having a lower end and an upper end, and a first cross bar extending between the upper ends of the legs, a second pair of spaced, parallel legs each having a lower end and an upper end, and a second cross bar extending between the upper ends of the second pair of legs, the first and second pairs of legs crossing over at a crossover point at an intermediate point in their lengths, and a pivot pivotally connecting the first and second pairs of legs together at the crossover point, the first and second pairs of legs being pivotable between a first, folded position in which the legs and cross bars are positioned side by side, and a second, deployed position in which the first and second pairs of legs are pivoted outwardly about said pivot such that the lower ends of the legs and the cross bars connecting the upper ends of the legs are spaced apart by a predetermined distance, spaced first and second connecting straps extending transversely between the cross bars in the deployed position of the stand, the first and second connecting straps being of predetermined length to control the maximum spacing between the cross bars in the deployed position, and each connecting strap being slidably engaged with the respective cross bars for movement along the cross bars in order to adjust the spacing between the connecting straps.

A hopper can be seated on top of the cross bars with a reduced dimension base portion of the hopper extending downwardly between the cross bars and engaging between the connecting straps. The connecting straps may be moved towards one another until they are in close engagement with opposite sides of the base portion of the hopper, so as to support the hopper in position and resist wobbling or displacement of the hopper during use. The connecting straps may be of any suitable pliable material such as rope, bungee cord, elastomeric material or the like, and have opposite ends in sliding engagement with the respective cross bars. The straps may be of resilient material so that they can grip against the opposite sides of the hopper base more securely. In an exemplary embodiment, each strap comprises an endless, elongate loop with opposite ends of the loop engaging over the respective cross bars. The loop may be formed of plastic material or the like by molding or extrusion.

According to another aspect of the present invention, a combination hopper and stand assembly is provided, which comprises a hopper having a container with an open upper end and a lower end, and a base at the lower end of the container, the base having a feeder extending across the lower end of the container for feeding drywall corner bead so that drywall mud in the hopper is applied to upwardly facing surfaces of the corner bead, the base having a lower portion of reduced dimensions, and a stand for supporting the hopper, the stand comprising a plurality of elongate legs each having a lower end and an upper end, and a support portion at the upper ends of the legs, the support portion comprising at least two spaced cross bars spaced apart at a predetermined spacing greater than the dimensions of the lower portion of the hopper base and less than the dimensions of the remainder of the base, whereby the hopper can be seated on top of the cross bars with the lower portion of the base extending downwardly between the cross bars, and spaced first and second connecting straps extending transversely between the cross bars, each connecting strap being slidably engaged with the respective cross bars for movement along the cross bars in order to adjust the spacing between the connecting straps to a spacing substantially equal to the width of the hopper base between the opposite sides, whereby the straps can be positioned to bear against the opposite sides of the hopper base.

With this arrangement, the hopper is held in a stable position at a raised elevation, where it can be readily used to apply drywall mud to corner beads both quickly and easily. A bucket for collecting excess mud can be placed beneath the feeder and between the legs of the stand, so that it is protected against being accidentally kicked over or tripping someone. The straps may be of resilient material so as to grip the opposite sides of the base more firmly. In an exemplary embodiment, each strap comprises an endless, elongate loop with opposite ends of the loop engaging over the respective cross bars. The loop may be formed of plastic material or the like. In an alternative arrangement, releasable fasteners may be provided to releasably secure the respective connecting straps to the opposite sides of the hopper base, such as screw fasteners, releasable clamping jaws, or the like.

The hopper and stand assembly of this invention allows a hopper to be held securely at a raised elevation convenient for use by an operator in a standing position. The connecting straps can be adjusted until they are in engagement with opposite sides of the hopper base in order to secure it against movement or wobbling during use.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
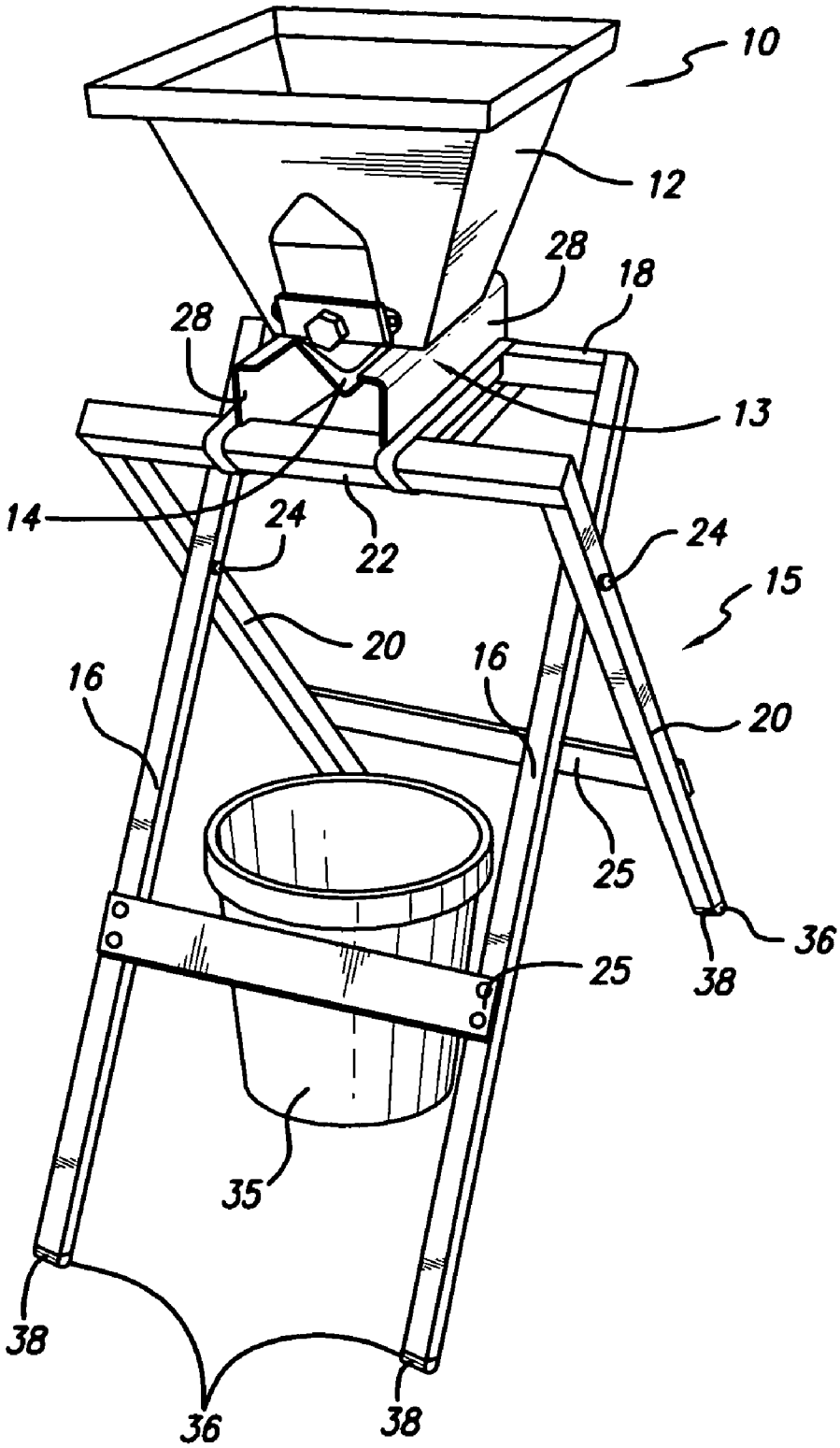
FIG. 1 is a front perspective view of a hopper and stand assembly according to an exemplary embodiment of the invention.
Figure 2:
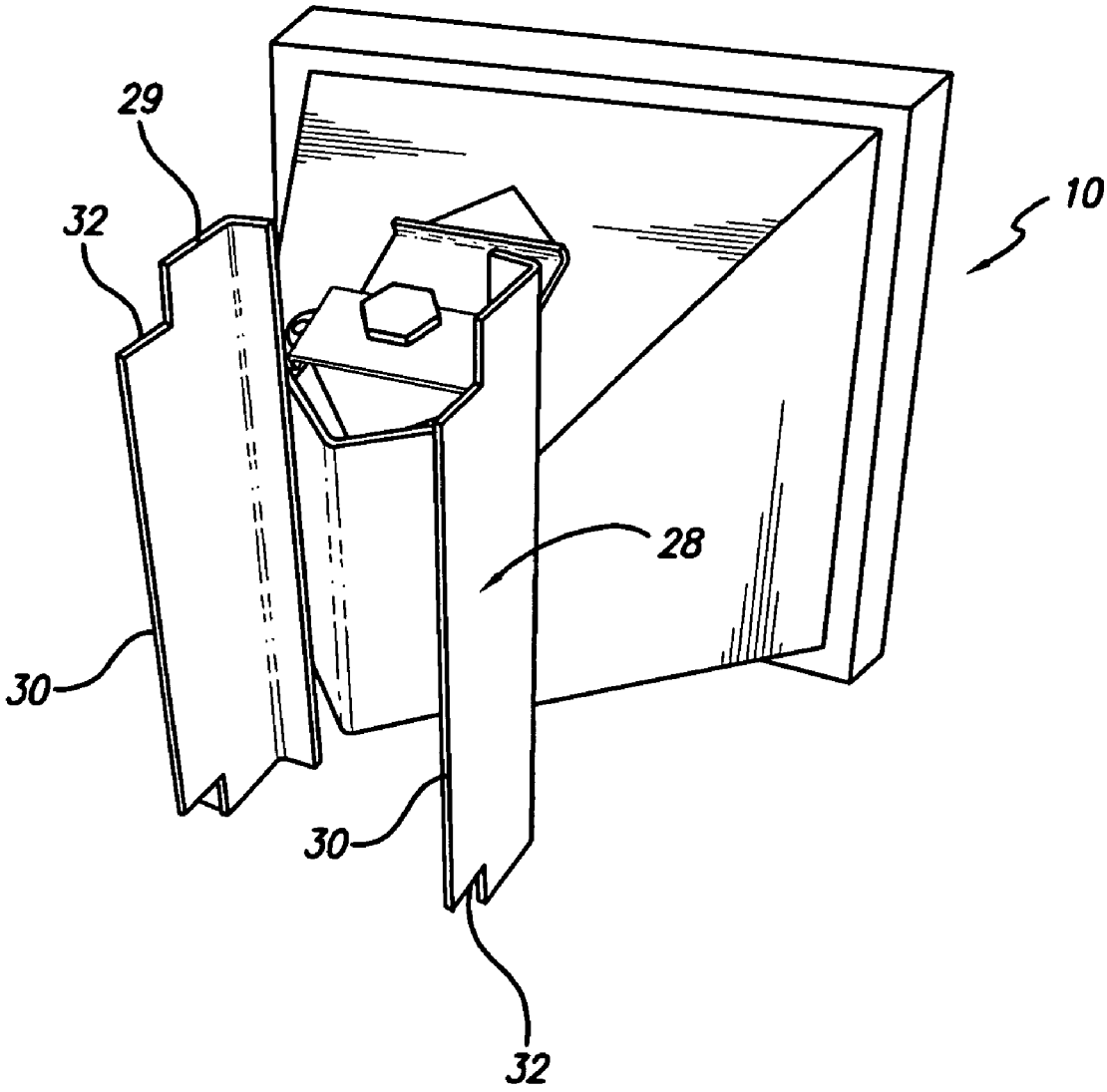
FIG. 2 is a bottom perspective view of the hopper.
Figure 3:
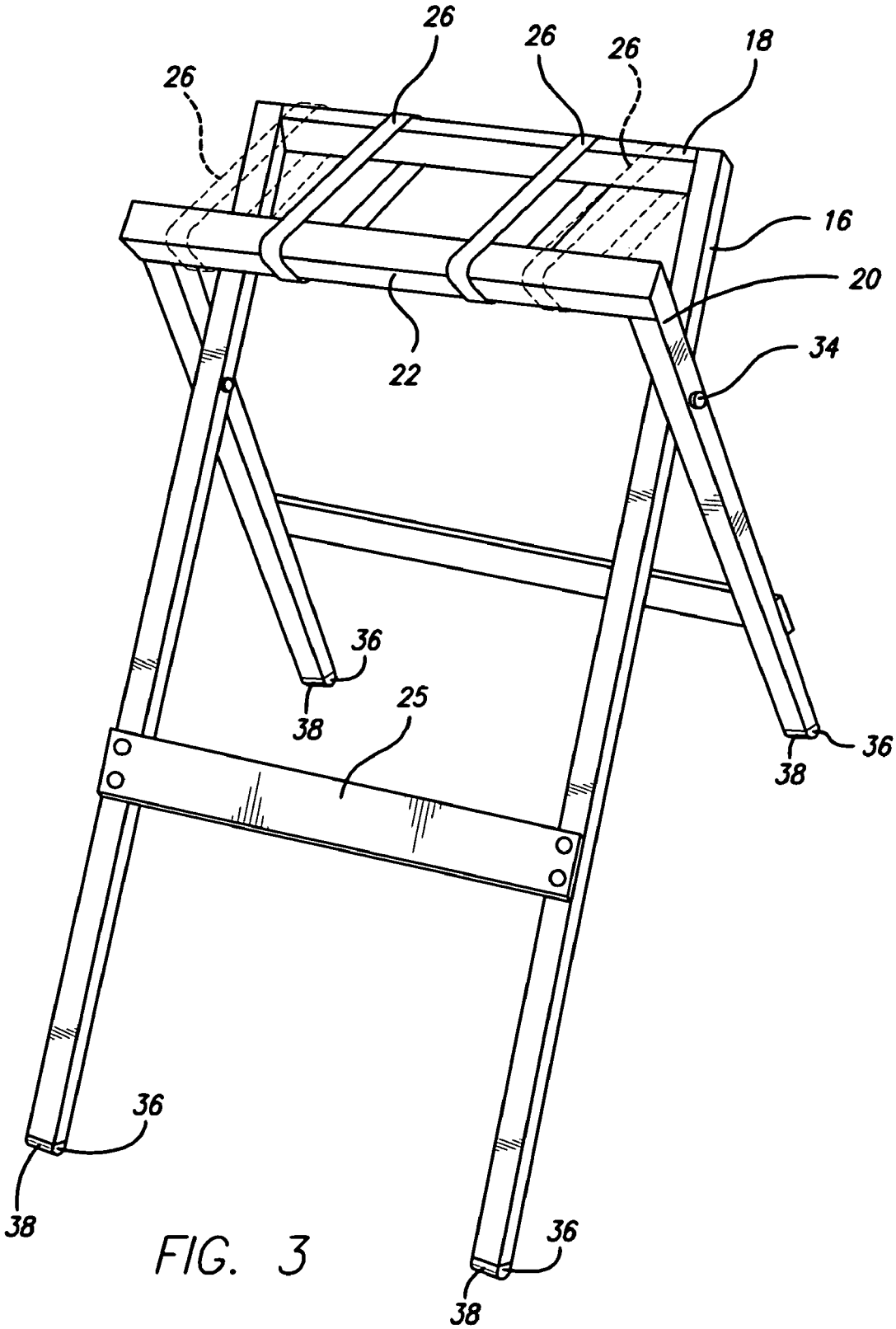
FIG. 3 is a side perspective view of the stand alone in a deployed position.
Figure 4:
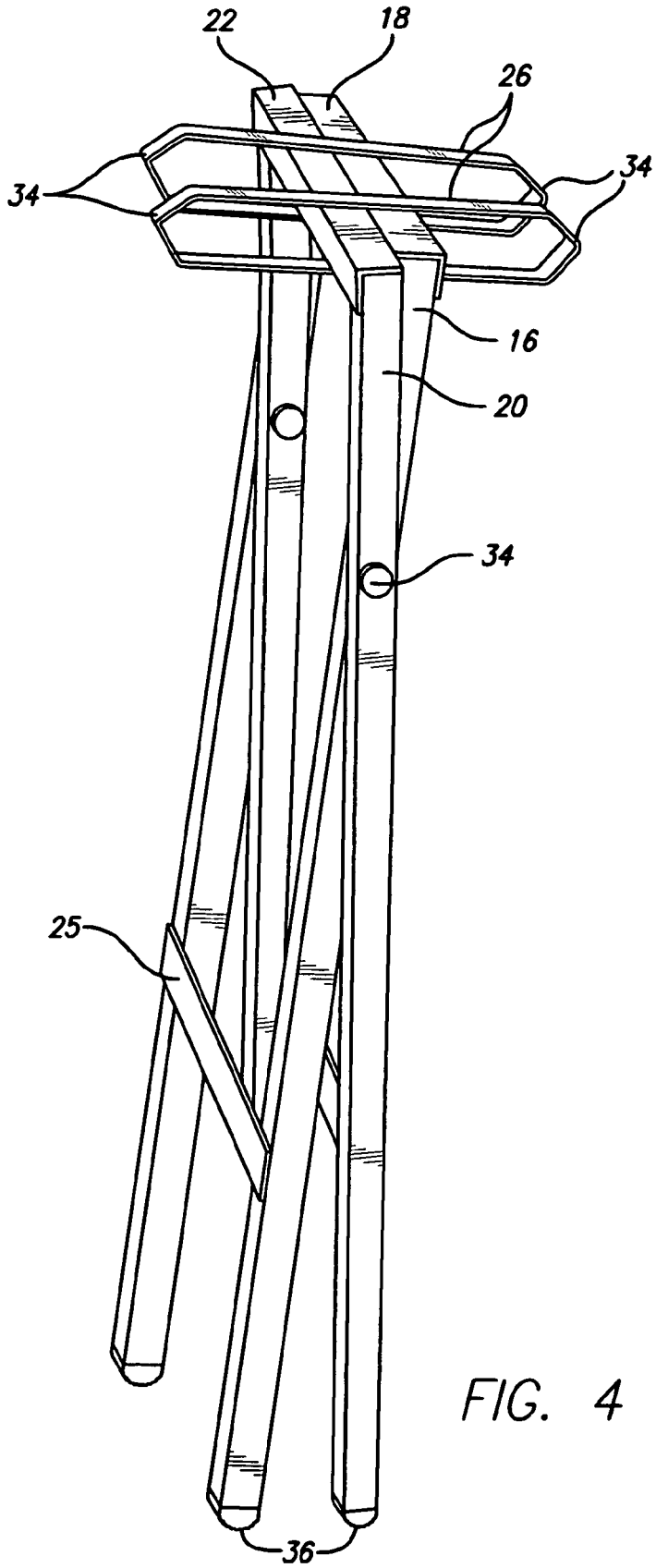
FIG. 4 is a side elevation view of the stand in a folded, collapsed position.

FIG. 1 of the drawings illustrates a hopper and stand assembly according to an exemplary embodiment of the present invention, while FIG. 2 illustrates the hopper base in more detail, and FIGS. 3 and 4 illustrate details of the stand.

The hopper 10 basically comprises an open-topped, outwardly tapered container 12 and a base 13 secured at the bottom of the container, the base 13 having a feeder 14 for feeding drywall tape or corner bead (not illustrated) through the base for coating with drywall mud from container 12. The stand 15 basically comprises a first pair of legs 16 secured together by a cross bar 18 at their upper ends, and a second pair of legs 20 secured together by a second cross bar 22 at their upper ends. The two pairs of legs are arranged to cross over in a scissors-like manner and are pivoted together at the leg cross over points via pivots 24. Lower cross bars 25 are secured between the respective pairs of legs at a location spaced below the pivots 24. Endless bands or connecting straps 26 extend transversely between the cross bars 18,22 in the upright, deployed condition of the stand as illustrated in FIGS. 1 and 3, and are slidable back and forth along the cross bars in order to adjust the separation between the straps, as indicated by the dotted line position of FIG. 3. The length of the bands or connecting straps controls the maximum separation between the cross bars 18,22 in the deployed position of the stand. The stand legs may be of metal bar or tubular metal bar material or the like, while the cross bars may be angle bars of rigid plastic or metal material.

In the assembled condition of FIG. 1, the hopper 10 is placed on top of the stand, with the base 13 seated on the cross bars 18,22 and the connecting straps or bands 26 moved up against opposite sides 28 of the base in order to hold the hopper in position and resist wobbling or displacement of the stand during use. As best illustrated in FIG. 2, the base 13 of the hopper has opposite side walls 28 and the feeder 14, in this case a V-shaped channel or groove, is secured between the side walls so as to extend across the bottom of container 12. The bottom of the container 12 has an opening (not visible in the drawings) so that drywall mud or joint compound in the container is fed into the feeder and applied to upwardly facing surfaces of a drywall corner bead as it is pulled through the feeder. Each side wall 28 has a longer upper portion with opposite ends 29 and a shorter lower portion 30 with opposite ends 32 each inset from the respective end of the upper portion. The spacing between the cross bars 18,22 is predetermined such that it is substantially equal to or slightly greater than the length of the lower portions 30 of the side walls, such that the lower portions 30 project downwardly between the cross bars 18,22, and the upper portions are seated on top of the cross bars, as illustrated in FIG. 1.

In the illustrated embodiment, the connecting straps 26 are endless loops, with the length of each loop selected so that the cross bars will be at the desired spacing when the stand is deployed. However, they may alternatively be single straps or lengths of suitable material, such as rope, bungee cord, or the like, with looped ends for sliding engagement over the respective cross bars. The endless loops may be engaged over the cross bars 18,22 before the cross bars are secured to the upper ends of the two pairs of stand legs. The loops or straps are suitably made of a flexible or bendable material, and will grip against the opposite sides of the hopper stand, holding the stand more firmly. In the exemplary embodiment, the loops 26 are of extruded, flat strip plastic material and have shaped, angled ends 34 matching the angled shape of the respective cross bars 18,22 when the stand is deployed, as best illustrated in FIGS. 3 and 4.

When the stand and hopper are assembled as in FIG. 1, a bucket 35 may be placed on the floor between the legs of the stand, as indicated, in order to collect any excess mud dripping from the feeder above it as the corner bead exits the feeder. This is a much more secure and stable arrangement than placing the hopper directly on top of the bucket, as was done in the past. A rubber foot 36 may be secured to the lower end of each metal leg 16,20 of the stand, as indicated in FIGS. 1,2 and 4. Each foot 36 has horizontal ribs or striations 38 to provide a better gripping surface and resist sliding of the stand on smooth surfaces such as concrete.

The stand may be collapsed for storage purposes when not in use, as illustrated in FIG. 4. The two pairs of legs are pivoted inwardly about pivots 24 into a closed position in which the upper cross bars 18,22 are side-by-side, releasing loops 26. The loops may be rotated downwardly if desired, so that they rest alongside the legs.

Although the stand has crossed over, pivoted support legs in the illustrated embodiment, the same upper support arrangement may be used in a stand with a different leg arrangement. All that is required is a set of supporting legs for supporting a pair of spaced cross bars at a raised height, and connecting straps or endless loops extending between the cross bars and slidable along the cross bars for bearing against opposite side walls of the base of a hopper supported on the cross bars. This will allow the hopper to be securely supported on top of the stand at a convenient height for use in applying a layer of joint compound to a corner bead.

Although an exemplary embodiment of the invention has been described above by way of example only, it will be understood by those skilled in the field that modifications may be made to the disclosed embodiment without departing from the scope of the invention, which is defined by the appended claims.

I claim:

1. A hopper and stand assembly, comprising:

a hopper comprising a container having an open upper end and a lower end, and a base extending across the lower end of the container for feeding drywall corner bead so that drywall mud in the hopper is applied to upwardly facing surfaces of the corner bead, the base having a lower portion of reduced dimensions; and a stand for supporting the hopper at a raised elevation above a floor, the stand comprising a plurality of elongate legs each having a lower end and an upper end, and a support portion secured at the upper ends of the legs;

the support portion comprising at least two spaced cross bars spaced apart at a predetermined spacing greater than the dimensions of the lower portion of the hopper base and less than the dimensions of the remainder of the hopper base, the hopper base being seated on top of the cross bars with the lower portion of the base extending downwardly between the cross bars, and spaced first and second connecting bands extending transversely between the cross bars, each connecting band being slidably engaged with the respective cross bars for movement along the cross bars in order to adjust the spacing between the connecting bands such that the bands bear against opposite sides of the hopper base.

2. The assembly as claimed in claim 1, wherein the legs of the stand comprise a first pair of spaced, parallel legs each having a lower end and an upper end, the first cross bar extending between the upper ends of the legs, and a second pair of spaced, parallel legs each having a lower end and an upper end, and the second cross bar extending between the upper ends of the second pair of legs, the first and second pairs of legs crossing over at a crossover point at an intermediate position in their lengths, and a pivot pivotally connecting the first and second pairs of legs together at the crossover point, the first and second pairs of legs being pivotable between a first, folded position in which the legs and connecting bars are positioned side by side, and a second, deployed position in which the first and second pairs of legs are pivoted outwardly about said pivot such that the cross bars connecting the upper ends of the legs are spaced apart by the predetermined spacing.

3. The assembly as claimed in claim 2, wherein the connecting bands are of pliable material.

4. The assembly as claimed in claim 2, wherein each band comprises an endless, elongate loop with opposite ends of the loop engaging over the respective cross bars.

5. The assembly as claimed in claim 4, wherein the loop has a predetermined length such that, when the stand is deployed with the cross bars at a maximum spacing and engaging opposite ends of the respective loops the cross bars are at said predetermined spacing.

6. The assembly as claimed in claim 5, wherein each cross bar has an angled outer corner and an angled inner corner, and opposite ends of each loop are pre-formed into an angled, generally V-shape to match and fit closely against the angled shape of the outer corner of the respective cross bar when the stand is deployed with the legs angled outwardly.

7. The assembly as claimed in claim 1, wherein the legs of the stand have rubber feet.

8. A stand for supporting a hopper for applying joint compound to a corner bead, the stand comprising:

a first pair of spaced, parallel legs each having a lower end and an upper end, and a first cross bar extending between the upper ends of the legs;

a second pair of spaced, parallel legs each having a lower end and an upper end, and a second cross bar extending between the upper ends of the second pair of legs;

the first and second pairs of legs crossing over at a crossover point at an intermediate position in their lengths;

a pivot pivotally connecting the first and second pairs of legs together at the crossover point, the first and second pairs of legs being pivotable between a first, folded position in which the legs and cross bars are positioned substantially side by side, and a second, deployed position in which the first and second pairs of legs are pivoted outwardly about said pivot such that the cross bars connecting the upper ends of the legs are spaced apart by a predetermined distance;

spaced first and second connecting bands extending transversely between the cross bars in the deployed position of the stand, the first and second connecting bands being of predetermined length to control the maximum spacing between the cross bars in the deployed position, and each connecting band being slidably engaged with the respective cross bars for movement along the cross bars in order to adjust the spacing between the connecting bands;

each connecting band comprising an endless, elongate loop with opposite ends of the loop engaging over the respective cross bars; and each cross bar having an angled outer corner and an angled inner corner, and opposite ends of each loop being pre-formed into an angled, generally V-shape to match and fit closely against the angled shape of the outer corner of the respective cross bar when the stand is deployed with the legs angled outwardly.

9. A method of supporting a drywall hopper while drywall mud from the hopper is applied to a corner bead, comprising the steps of:

deploying a stand comprising first and second pairs of spaced parallel legs each having an upper cross bar extending between the upper ends of the pair of legs, the pairs of legs pivoted together at a cross over point at an intermediate position in their lengths, the first and second pairs of legs being pivoted outwardly in the deployed position with the upper cross bars spaced apart at a first predetermined spacing and the lower ends of the first and second pair of legs being spaced apart at a second predetermined spacing, and a pair of bands each extending transversely between the upper cross bars;

placing a bucket in the space between the lower ends of the first and second pairs of legs with the open end of the bucket facing upwardly towards the spacing between the upper cross bars;

positioning a hopper on top of the stand with a lower base portion of the hopper projecting downwardly between the upper cross bars and between the bands, and an upper base portion of larger width than the lower base portion seated on top of the upper cross bars, the base portion of the hopper having opposite side walls facing outwardly towards the respective bands and extending transverse to the cross bars; and sliding each band inwardly along the respective cross bars to engage the respective side wall of the hopper base portion.

* * * * *